US005821358A

United States Patent [19]

Gilkes et al.

[11] Patent Number: 5,821,358

[45] Date of Patent: Oct. 13, 1998

[54] METHODS AND COMPOSITIONS FOR MODIFICATION OF POLYSACCHARIDE CHARACTERISTICS

[75] Inventors: Neil R. Gilkes; Douglas G. Kilburn, both of Vancouver; Robert C. Miller, Jr., North Vancouver; Anthony Warren, Vancouver, all of Canada

[73] Assignee: University of British Columbia, Vancouver, Canada

[21] Appl. No.: 269,614

[22] Filed: Jun. 30, 1994

Related U.S. Application Data

[63] Continuation of Ser. No. 751,703, Aug. 29, 1991, abandoned.

[51] Int. Cl.[6] ..... C12P 19/04

[52] U.S. Cl. ..... 536/56; 536/57; 536/76; 435/72; 435/101

[58] Field of Search ..... 536/56, 76, 57; 435/72, 101

[56] References Cited

U.S. PATENT DOCUMENTS

| | | | |
|---|---|---|---|
| 4,036,586 | 7/1977 | Rowe | 8/532 |
| 4,479,881 | 10/1984 | Tai | 252/8.8 |
| 4,630,622 | 12/1986 | Foreman | 132/253 |
| 4,738,682 | 4/1988 | Boegh et al. | 8/401 |
| 4,822,516 | 4/1989 | Suzuki et al. | 252/174.12 |

FOREIGN PATENT DOCUMENTS

| | | |
|---|---|---|
| 773280 A | 3/1972 | Belgium . |
| 0 290 027 A | 11/1988 | European Pat. Off. . |
| 1368599 | 10/1974 | United Kingdom . |
| WO 91/10732 | 7/1991 | WIPO . |

OTHER PUBLICATIONS

Gilkes et al. in J. Biol. Chem. 213, pp. 10,401–10,407.

Morehead "Microscopical Investigations" Cellulose and Cellulose Derivatives, part IV, vol. V, pp. 213–263 1971 (month unavailable).

*Primary Examiner*—Jeffrey Mullis

*Attorney, Agent, or Firm*—Rae-Venter Law Group, P.C.

[57] ABSTRACT

Methods and compositions are provided for the modification of polysaccharide structures using polysaccharidase binding or catalytic domains either alone or in tandem to modify the structure of polysaccharides. These methods and compositions are exemplified by the use of cellulase binding and catalytic domains to polish cotton, and to alter dying characteristics, texture and porosity of cellulose fibers.

20 Claims, 6 Drawing Sheets

FIG. 1A
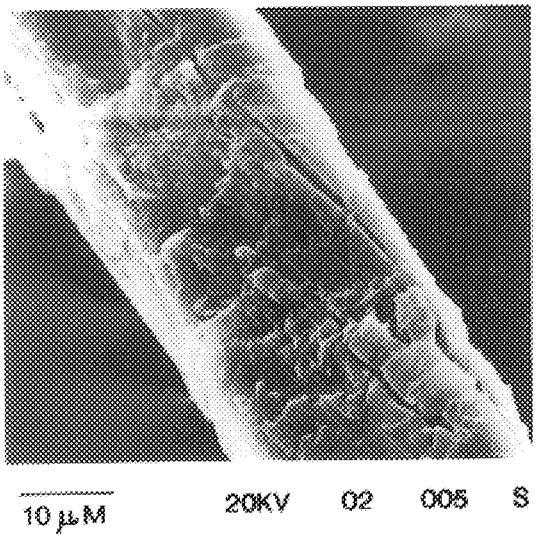
FIG. 1B
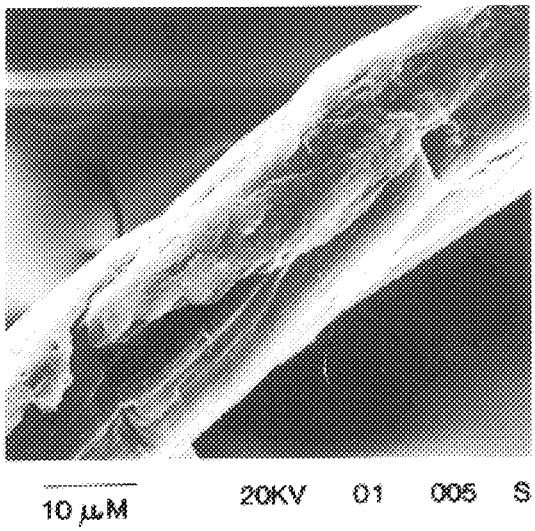
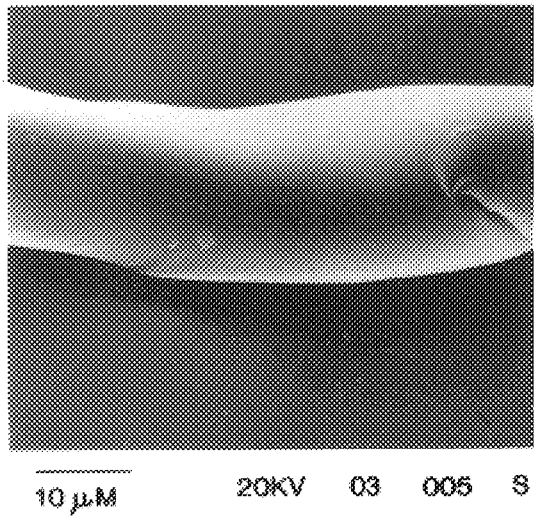
FIG. 1C
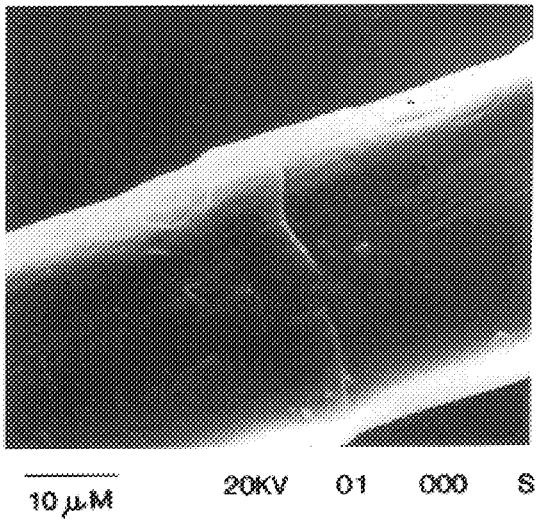
FIG. 1D

METHODS AND COMPOSITIONS FOR MODIFICATION OF POLYSACCHARIDE CHARACTERISTICS

INTRODUCTION

This is a continuation of application Ser. No. 07/751,703, filed Aug. 23, 1991, now abandoned.

TECHNICAL FIELD

This invention relates to methods and compositions for modification of polysaccharide characteristics using polysaccharidases and/or their functional domains. The method is exemplified by the use of an isolated cellulose binding domain of a bacterial endoglucanase to disrupt the structure of cellulose fibers and the use of an isolated catalytic domain of this enzyme to polish the surface of the fibers.

BACKGROUND

Polysaccharides are ubiquitous, stable structural components found in nature. Many organisms use polysaccharides as structural material inside and outside of their cells to provide 3-dimensional shape and surface structure. The structural integrity of polysaccharides from natural sources is often retained after the isolation of the polysaccharide, allowing it to be used for a variety of commercial purposes. Owing to their desirable physical characteristics polysaccharides have also been produced by synthetic methods for commercial purposes. In either case, polysaccharides from either synthetic or non-synthetic sources comprise the raw material for a variety of commercially important products such as paper pulp, agricultural produce and fibers.

Polysaccharide structures generally are stable and relatively inert to a variety of chemical conditions. This gives both non-synthetic and synthetic products prepared from polysaccharide structures the desirable characteristics of durability, strength and resistance to aging. However, raw or unprocessed polysaccharidic structures often have undesirable characteristics due to precisely the same physical properties that give them their desirable characteristics. The undesirable characteristics generally include coarse texture, inflexibility, hardness, and abrasiveness, although for some applications some of these characteristics may be preferred. Such traits are particularly common for raw, natural fibers that have not been processed.

Methods do exist to refine and alter the structure of polysaccharides used for commercial products which include mechanical disruption, polishing, washing and spinning of fibers into finer threads and materials. However, it would be of interest to develop an alternative approach to mechanically polishing natural and synthetic polysaccharide structures to facilitate refining of polysaccharide structures, particularly in a predictable, specific fashion. Such refinements could include changing the texture, appearance, touch and feel of the polysaccharide structure.

RELEVANT LITERATURE

Two cellulases from *C. fimi*, an exoglucanase (Cex) and an endoglucanase (CenA), have been characterized and their genes, cex and cenA, respectively, have been sequenced (Wong et al., *Gene* (1986) 44:315–324; O'Neill et al., *Gene* (1986) 44:325–330). Predicted amino acid sequences show evidence of domain structure for these enzymes (Warren et al., *PROTEINS: Structure, Function, and Genetics* (1986) 1:335–341). Several cellulase genes from *Cellulomonas fimi* have been cloned into *Escherichia coli* (Whittle et al., *Gene* (1982) 17:139–145; Gilkes et al., *J. Gen. Microbiol.* (1984) 130:1377–1384) and the gene fragment encoding the cellulose binding domain and the cellulose binding domain connected to the PT box of CenA have been cloned in *E. coli*. (Gilkes, et al. 1988).

Domain structures have also been observed in other cellulases (Teeri et al., *Publications* (1987) 38: Technical Research Centre of Finland; Teeri et al., *Gene* (1987) 51:43–52) and separation of domains by proteolytic cleavage has given some insight into domain function (Langsford et al., *FEBS Letters* (1987) 225:163–167; Tomme et al., *Eur. J. Biochem.* (1988) 170:575–581; van Tilbeurgh et al., *FEBS Letters* (1986) 204:223–227). See also Kellet, et al., *Biochem J.* (1990) 272: 369–376, Watanabe, et al. *J. Biol Chem* (1990) 265; 15659–15665, Svensson, et al., *Biochem J.* (1989) 264: 309–311, and Takahashi, et al.).

SUMMARY OF THE INVENTION

The present invention provides methods and compositions for modification of polysaccharide structures using functional domains of polysaccharidases. The method includes the step of contacting a polysaccharide structure with a sufficient amount of a functional domain obtainable from a polysaccharidase under conditions and for a time sufficient to modify a characteristic of the polysaccharide. The surface area of the polysaccharide structure may be roughened by using a binding domain whereas the surface may be smoothed by using a catalytic domain. The methods and compositions find use in producing polysaccharide structures with altered mechanical or physical properties.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

FIG. 1 shows scanning electron micrographs of ramie cotton fibers treated with CenA (A), CBD.PT (B) and p30 (C). CenA refers to intact endoglucanase A; CBD.PT to the cellulose binding domain with attached linker; CBD to the cellulose binding domain alone; and p30 to the catalytic domain. A control fiber which had been incubated with the phosphate-azide buffer alone is shown in (D). Areas where the fibers have been eroded are apparent for fibers treated with the CenA, CBD.PT and CBD (not shown but indistinguishable from CBD.PT treated fiber). In sharp contrast, p30 treated fibers appear to have a very smooth and even surface. Protein concentrations were all 10 $\mu$M, i.e., CenA, 0.5 mg $mg^{-1}$, CBD.PT, 0.16 mg $ml^{-1}$; p30, 0.34 mg $ml^{-1}$.

BRIEF DESCRIPTION OF THE SPECIFIC EMBODIMENTS

Figure 2A:
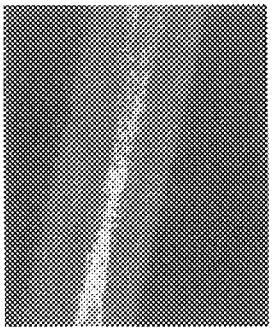
FIG. 2 shows micrographs of Ramie cellulose fibers which were pretreated with CenA, CBD.PT or p30, then labelled with FITC-CBD and examined by confocal microscopy. FITC-CBD is CBD coupled to fluorescein isothiocyanate which makes it fluorescent under light of the appropriate wavelength. (A) and (B) show the control fiber, which had not been pretreated, after incubation with FITC-CBD. (A) shows a composite of 9 slices through the fiber and (B) shows a mid-section slice. Fluorescence was apparent only on the surface of the fiber and only at natural surface irregularities. (C) and (D) show, respectively, the composite image and mid section slice from the fiber which had been pretreated with the CBD.PT, followed by FITC-CBD. The presence of label in the mid section slice reflects disruption of the fibril structure by the pretreatment with CBD.PT. (E) and (F) show the composite and the mid section slice from the CenA pretreated fiber. Again there is fluorescence within the fiber, indicating the opening of the fiber structure caused by the CenA. The p30 pretreated fiber (G) shows very little binding of FITC-CBD. The fluorescence is confined to the smooth surface as there is no detectable fluorescence in the mid section slice (H).
Figure 2B:
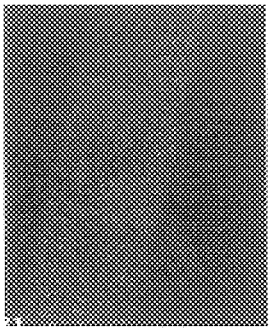
Figure 2C:
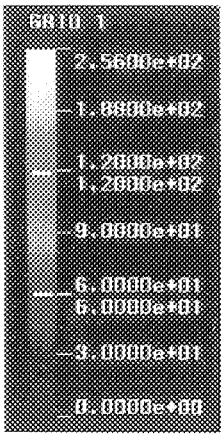
Figure 2C:
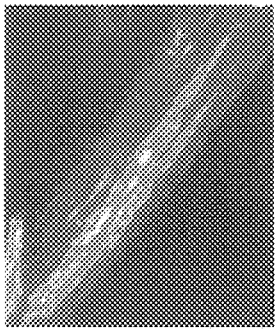
Figure 2D:
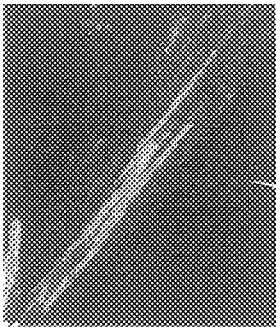
Figure 2E:
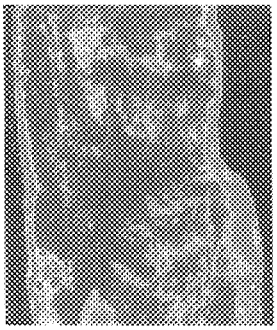
Figure 2F:
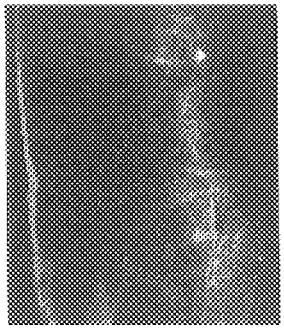
Figure 2G:
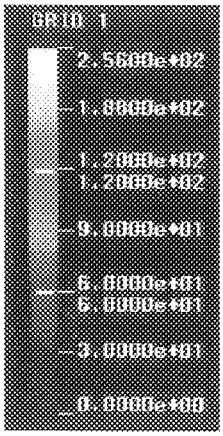
Figure 2G:
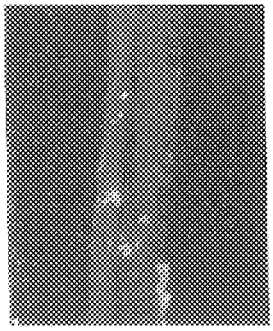
Figure 2H:
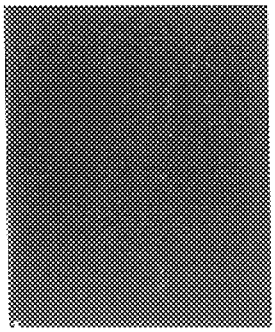

In accordance with the subject invention, methods and compositions are provided which allow for alteration of characteristics of polysaccharide structures such as cotton and Ramie fibers. The compositions comprise modifying agents which provide for controlled changes to the physical and mechanical properties of a polysaccharide structure, particularly changes which relate to opening or closing of the fibrillar structure. The modifying agent is a functional domain obtainable from a polysaccharidase (E.C.3.2.1.4.). The method involves contacting a polysaccharide that optionally has been pretreated to remove any surface coating such as wax or gum with the modifying agent, generally with agitation under conditions and for a time sufficient to effect a desired modification of the polysaccharide.

A polysaccharidase is defined as an enzyme capable of catalyzing the enzymatic cleavage of a polysaccharide. Typically the polysaccharidase has at least two functional domains, a binding domain and a catalytic domain. The binding domain is defined as an amino acid sequence that binds to a polysaccharide whereas the catalytic domain is defined as an amino acid sequence that is capable of enzymatically cleaving a polysaccharide. The type of modification of the polysaccharide structure that is achieved will depend upon whether the modifying agent is a binding domain or a catalytic domain.

Binding domains and catalytic domains which are specific for a variety of polysaccharides are available. For example, the cellulose binding domain of *C. fimi* endoglucanase A (CenA) comprises the N-terminal region of a 111 amino acids of the enzyme. The catalytic domain is located at the C-terminus and is 284 amino acids in length. A "linker sequence" connects the two functional domains; the linker is a 23 amino acid peptide, containing only proline and threonine residues, called the PT box. Similar bi-functional organization of polysaccharidases with separable functional domains, mediating either binding or hydrolysis is now recognized as a structure motif of many polysaccharidases. In a xylanase and an arabinofuranosidase the substrate binding region is in the first 110 amino acids at the N-terminus (Kellet et al., supra). Chitinase exhibits a binding domain in the C-terminus of the enzyme of 2 different species (Watanabe et al., supra). In glucoamylase the binding domain is located either at the C- or the N-terminus, depending on the species (Svensson et al., supra and Takahashi et al., supra).

Modification by a polysaccharidase binding domain is defined as an observable change in the structure of the polysaccharide. This includes a conformational change which results in disruption of polysaccharide fibers, opening of polysaccharide fibers, aggregation of the polysaccharide structure or dissociation of the structure and the like. Modification may also be defined as a change in polysaccharide structure due to chemical cleavage of polysaccharide bonds. Such cleavage leads to observable microscopic and macroscopic modifications such as reduction in surface area, change in shape, change in texture, appearance, luster and the like.

Generally the binding domain will be characterized as binding specifically to polysaccharides with a dissociation constant of less than one millimolar ($Kd=1\times10^{-3}M$). Tighter polysaccharide binding by the polysaccharide binding domain, with micromolar and sub-micromolar dissociation constants is preferable. Generally, it will be preferable to have a dissociation constant for a specific polysaccharide which results in least two orders of magnitude tighter binding as compared to the dissociation constant of a non-specific polysaccharide.

Binding domains can be obtained by any of a variety of techniques, including biochemical or genetic engineering techniques. Thus, they can be obtained by proteolysis (see, for example, Gilkes et al., *J. Biol Chem* (1988) 213: 10401–10407) or by gene manipulation using techniques known to those skilled in the art. Additionally, isolated polysaccharidases may be chemically modified to inhibit catalytic activity while retaining binding activity. To produce catalytically incompetent polysaccharidases that bind polysaccharides, protein-modifying reagents can be used in the presence of saturating concentrations of polysaccharide substrates where the binding of the polysaccharide ligand or polysaccharide-like ligand protects the substrate binding site, but allows the modification of an amino acid that is either essential to activity or blocks activity. Alternatively, a specific inhibitor which inactivates the enzyme could be used.

Similarly, catalytically incompetent polysaccharidases may be produced by genetic engineering techniques, either through random mutation or site-directed mutagenesis. Using site-directed mutagenesis, specific amino acids relating to the catalytic activity of the polysaccharidase can be mutagenized and replaced by amino acids that inhibit or block catalytic activity, but do not interfere with the binding of polysaccharide. For example, in CenA, aspartate number 283 could be replaced. Such an approach effectively generates an amino acid sequence quite similar to the original polysaccharidase sequence, but the functional domain containing the catalytic activity has been rendered incompetent by mutagenesis or biochemical modification; only the binding domain is functional.

Amino acid sequences corresponding only to the polysaccharide binding domain, may be used rather than the entire polysaccharide sequence with specific mutations or modifications. In this case, the binding domain may be obtained by cleaving the polysaccharidase into functional domains. For example, an isolated polysaccharidase can be subjected to protease treatment that cleaves the protein into two or more fragments consisting of functional domains. On occasion the polysaccharidase will contain a specific protease site. For example, *C. fimi* endoglucanase A (CenA) contains a PT box which is cleaved by a conformation-specific *C. fimi* protease.

The products of that reaction are a polysaccharide binding domain with a PT sequence and a polysaccharidase catalytic domain. If the polysaccharidase is not cleaved by highly sequence specific proteases it will be subject to less specific proteases, and the active fragments can be isolated by chromatography and other peptide purification techniques known to those skilled in the art.

Other techniques which can be used to obtain a binding domain include use of amino acid sequence information to generate probes for the cloning of DNA sequences encoding polysaccharidases. These cloned sequences can be used to generate deletion mutants encoding only the polysaccharide binding domains. Conversely, if the cDNA sequence of a polysaccharidase or polysaccharide binding protein is known then a DNA sequence can be specifically constructed that corresponds to the polysaccharide binding domain by using biochemical, amino acid, and DNA sequence data to predict the location of polysaccharidase binding domain based on sequences homologies to other polysaccharidases. Binding activity can be determined, for example, by binding to microcrystalline cellulose such as Avicel and showing that the putative binding domain is removed from solution. A polypeptide having the desired activity is readily isolated in highly purified form from the cellulose. Binding to Avicel (microcrystalline cellulose) has been used for purification of both native (Gilkes et al., *J. Biol. Chem.* (1984) 259:10455–10459) and recombinant cellulases (Owolabi et al., *Appl. Environ. Microbiol.* (1988) 54:518–523).

In any of these cases, the isolated polysaccharide binding domain will be sufficiently pure to exclude catalytic polysaccharidase activity. Preferably, the catalytic activity of such preparation will be less than that of crude extracts from cells expressing the polysaccharidase. More preferably, the catalytic activity will reflect a stoichiometry of less than 1 functional catalytic domain per 1000 functional binding domains.

Modification by polysaccharidase catalytic domains is defined as smoothing of the fiber surface and may be used to modify the overall structure of a polysaccharide matrix. Generally the catalytic domain will be defined as capable of enzymatic hydrolysis of a polysaccharide reactant to form a product, particularly cleavage of O linkages in polysaccharides. Catalytic domains will not necessarily specifically hydrolyze a certain type of polysaccharide, however it is preferable that the catalytic domain specifically hydrolyzes a particular polysaccharide. The Km of the catalytic domain will be at least one order of magnitude smaller for a specific polysaccharide as compared to other polysaccharides. The activity of a catalytic domain will be sufficient to detect the formation of product due to catalytic cleavage of polysaccharides. The preferred activity of the polysaccharide catalytic domain will have a Vmax of about 1.0 $\mu$mode product|min|mg protein at 25° C.

A polysaccharide catalytic domain may be derived from a polysaccharidase, for example, by chemical modification so that the binding activity of the polysaccharidase associated with the binding domain, is inhibited or blocked and the catalytic activity of the polysaccharidase is retained. See Gilkes et al., *J. Biol Chem* (1988) 263: 10401–10407 and Gilkes et al., *J. Biol Chem* (1989) 264: 17802–17808. This can be accomplished by using biochemical techniques where a transition state analog or similar ligand for the polysaccharidase catalytic reaction is used to protect amino acid residues essential for catalytic activity while the remainder of the enzyme, including the polysaccharide binding domain, is biochemically modified with group reagents specific for amino acids involved in polysaccharide binding. In this manner, a catalytically competent polysaccharidase can be generated that is incapable of binding a polysaccharide. In essence, the polysaccharidase sequence contains only functional residues that are capable of catalysis, and residues important to binding are modified to inhibit binding.

Alternatively, a cDNA polysaccharidase sequence can be used to generate a polysaccharidase incapable of binding a polysaccharide but catalytically active. The cDNA sequence may be mutated by selective or site-directed mutagenesis so that amino acids essential for binding are replaced with amino acids that inhibit binding or amino acids that are not essential for binding are substituted for amino acids that block binding. In this manner the genetically modified polysaccharidases will be incapable of binding a polysaccharide and capable of retaining catalytic activity.

Exemplary of the isolation of a catalytic domain is the isolation of the catalytic domain of CenA from *C. fimi*. This polysaccharide catalytic domain is designated as p30. p30 may be prepared by chromatography techniques and *C. fimi* protease digestion where CenA is purified by affinity chromatography and then subjected to *C. fimi* protease digestion followed by size exclusion chromatography (see Gilkes, et al. (1988) supra).

A polysaccharide catalytic domain may also be generated from the cDNA sequence of a polysaccharidase by deleting the nucleotides encoding the binding domain.

Catalytic domains also may be prepared by recombinant DNA techniques utilizing DNA constructs comprising a DNA sequence that corresponds to the amino acid sequence of at least the catalytic domain. Such constructs are used to transform an appropriate host cell which is then grown to express the polysaccharide catalytic domain. If the catalytic domain has not yet been identified by biochemical techniques such as those used to identify p30, then the polysaccharidase is digested with a protease, the fragments fractionated and several of them sequenced by standard techniques. The determined amino acid sequences can then be used to derive oligomeric DNA probes for the purpose of cloning and isolating the polysaccharidase gene. The nucleotide sequence of the gene is determined and used to predict the amino acid sequence of the polysaccharidase. The catalytic domain sequence can then be determined by comparing the amino acid with these of other polysaccharidases.

If, on the other hand, the cDNA sequence has already been determined for a particular polysaccharidase then the predicted amino acid sequence can be used to determine which fragments can be obtained from the DNA sequence which encode the amino acid sequence with catalytic activity, that was isolated and derived from the protease digestion fragment. That DNA sequence can then be used to construct a DNA sequence capable of expression in a host cell. The protein may then be expressed and isolated as a recombinant polysaccharide catalytic domain. The term recombinant polysaccharide catalytic domain will not be limited however to this example. For instance, it could also be used to describe a recombinant polysaccharide catalytic domain generated from mutations of a polysaccharidase gene that did not involve deletion constructs but instead was engineered by site-directed or selected mutagenesis. The catalytic domain is isolated by protein purification using the catalytic activity to follow the purification.

In using the subject invention, polysaccharide structures may be modified using polysaccharidase functional domains, either binding or catalytic domains by contacting a polysaccharide structure with a sufficient amount of the functional domain for a time sufficient to achieve a desired modification under appropriate conditions of reagents, temperature and the like. Conditions of modification generally will be optimized to provide for the binding affinities, Km, Vmax, and kcat and other biochemical parameters such as pH optima of the functional domain used. The interaction of the binding domain with substrate is extremely rapid. To achieve a desired effect, it is therefore necessary to evaluate various of concentration of binding domain, and/or time and/or temperature of treatment to achieve a desired effect. The conditions used will be based upon the requirements of the functional domain used and the desired end result. Typical conditions for endoglucanase functional domains include mM phosphate, pH 7.0, a concentration of functional domain generally of about 0.1–10 mg/ml per 25 mg of pretreated cellulose fiber such as cotton. The temperature is generally 20°–37° C., preferably about 25° C. The time of treatment will vary from 5 min to up to 12 hours, although longer treatments may be used so long as the fibers are not damaged. Generally the mixture is gently agitated to facilitate uniform treatment of the fibers.

An assay of the progress of modification or the rate of reaction can be used for the detection of inhibitory end products that might be formed during the modification treatment and for the detection of intermediate or find desirable properties that may be produced during treatment. For example, it may be desirable not to let the catalytic reaction go to completion where all possible substrates are cleaved. Rather, it may be preferable to stop the reaction at an intermediate point to obtain polysaccharide structures having desirable properties that are present due to incomplete cleavage of the structure.

The same is true of the polysaccharide binding domain, where binding of the binding domain to the polysaccharide may induce a conformational change or disruption in macromolecular structure that changes the shape, texture or surface area of the polysaccharide structure. In this way, variable changes in shape, surface area and texture can be accomplished. The progress of reaction can be measured using electronmicroscopy measurement, fluorescent microscopy or spectrophotometric analysis of polysaccharide structure and reactions. To facilitate the modification of the polysaccharide structure, the structure may be agitated or heated, prior to or during treatment, to expose structures on the polysaccharide that may be modified by either the polysaccharide binding or polysaccharide catalytic domains.

Exemplary of the subject invention is the use of functional domains of an endoglucanase from *C. fimi* to modify the structure of cotton or Ramie fibers. Although there is no detailed structural model for cotton or ramie fibers, there is general agreement regarding many features of these fibers. Cotton contains a primary cell wall and two or three layers of secondary cell wall surrounding a central lumen (Nevell and Zeonian, "Cellulose Chemistry Fundamentals" In: *Cellulose Chemistry and its Applications* (Nevell and Zeonian, Eds) (1985) pp. 15–29. John Wiley and Sons, New York). Native fibers have an outer waxy cuticle which is removed during pretreatment to remove wax. Ramie fibers are similar, but have only a single wall and the waxy cuticle is replaced by gum. Cheek and Roussel Textile Research Journal (1989) 59:478–483. The walls of both fibers contain cellulose microfibrils. In cotton, the microfibrils are approximately 25 nm. (Kolpak and Blackwell Textile Research Journal (1975) 45:568–572). Microfibrils appear to result from coalescence of smaller elementary fibrils.

The microfibrils of both cotton and Ramie fibers are highly crystalline and diffraction analyses indicate that the β-1,4-glucan chains are oriented in parallel, the typical cellulose I crystal structure of native cellulose (Blackwell (198) Biogenesis, Structure and Degradation (Brown, Jr. Ed) pp. 403–428) Plenum Press, New York. Fibers which have been pretreated to remove wax or gum show numerous surface irregularities and some transverse fissures as a result of mechanical damage. Presumably, surface irregularities comprise partially exfoliated microfibrillar sheets (i.e. small particles) still bound non-covalently to underlying fibers or attached at their ends to more coherent microfibrils of the fiber structure. Where it is desired to roughen the surface of Ramie and cotton fibers, isolated binding domain may be used. It is a theory of the invention, that the binding domain binds to and penetrates the fiber at surfaces discontinuities which may be a result of the pretreatment and sloughs off the cellulose fragments which are non-covalently associated with the fiber but are still bounded to the underlining fibrils. Further penetration of the binding domain exfoliates the fiber structure, releasing the ends of cellulose chains which remain bound to the fiber thus roughening the surface.

Quite different results from those achieved by use of a binding domain may be obtained by use of a catalytic domain. Use of the catalytic domain results in a "polishing" of the fiber surface so that the original surface disruptions following pretreatment to dewax or degum the fiber are no longer visible. It is a theory of the invention that the catalytic domain hydrolyses glycolytic bonds on the surface of the cellulose where the surface is disrupted or broken away from the crystalline structure resulting in the observed smoothing. A rational design of a cellulose hydrolysis scheme could involve balancing these activities by tandem application of binding domain and catalytic domain to maximize the rate of solubilization; alternatively the hydrolytic activity or the disruptive properties of the individual functional domains may be applied separately to achieve a desired result.

Polysaccharides which may be treated with cellulose binding domains include cotton, pulp, wood and paper. The methods and compositions of the subject invention find particular use in surface polishing, surface disruption and fiber disruption (which may be used to change dye holding capacity), modifications of texture and strength; removing loose ends and tying up loose ends or creating loose ends to change texture. The dye holding capacity may be changed, for example, by initial treatment of the surface of the cellulose fibers with binding domain followed by treatment with a dye molecule bound to a binding domain which may then further penetrate into the polysaccharide structure. Alternatively, dye molecules unbound to binding domain may also penetrate more extensively into the fibers following treatment of the structure with binding domain to open up the fibers. The treatment with binding domain should not significantly effect fiber strength because the binding domain does not break covalent bonds in the polysaccharide structure. Treatment of fibers with the catalytic domain removes any surface discontinuities already present by hydrolizing covalent bonds holding the small particles to the fiber surfaces. Use of the catalytic domain alone will not penetrate the fibers and thus there should be relatively little effect on fiber strength. The surfaces of the fibers will be "polished" or made smoother by removal of the "loose ends" or surface discontinuities.

The following examples are offered by way of illustration and not by way of limitation.

EXAMPLES

Example 1

Purification of CenA, p30 and CBD.PT CenA

Figure 3:
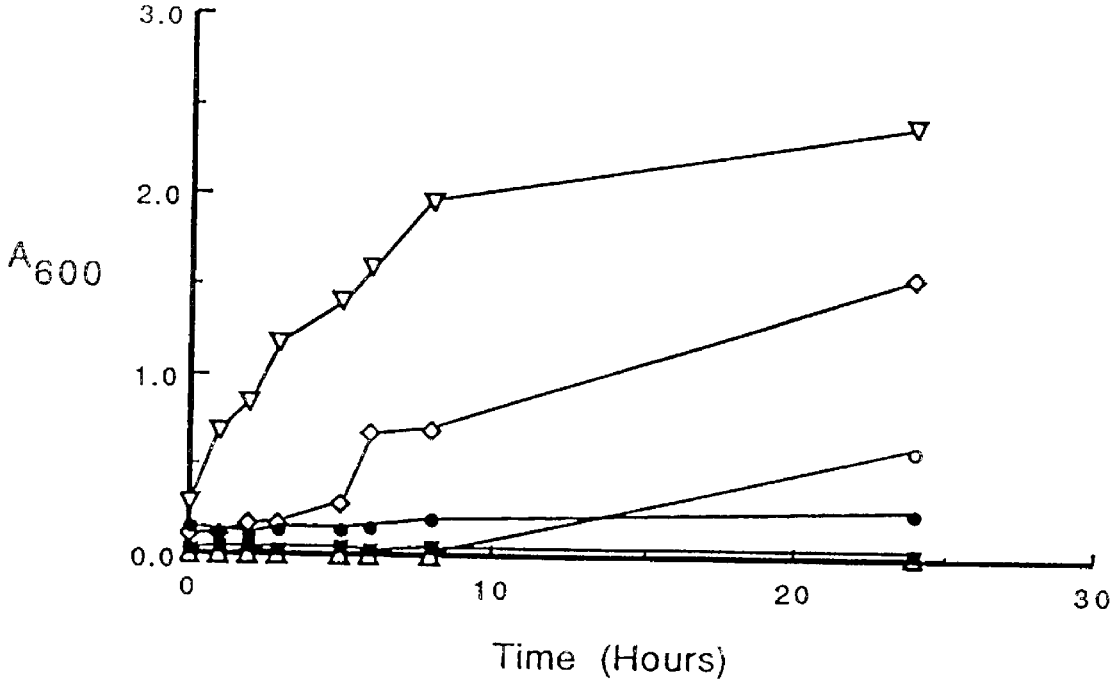
FIG. 3 shows small particle production from dewaxed cotton. $A_{600}$ readings were taken for the supernatants from cotton incubated 72 h with CenA, ▽, 0.5 mg $ml^{-1}$; CBD.PT, ●, 0.16 mg $ml^{-1}$; or p30, ◇0.34 mg $ml^{-1}$ in phosphate azide buffer. Controls included cotton only, ■; CBD.PT only, Δ; and CenA only, O.

Purification of the non-glycosylated form of CenA, synthesized from recombinant *C. fimi* DNA in *E. coli* (FIG. 3, lane 3), has been described in Gilkes et al., *J. Biol Chem* (1988) 263: 10401–10407. This enzyme is cleaved by a *C. fimi* protease between Thr 165 and Val 166 (i.e. at the carboxyl terminus of the P.T. box) into two fragments Gilkes et al. (1988) supra; Gilkes et al. *J. Biol Chem* (1989) 264: 17802–17808. The stable, 29.7 kDa, carboxyl-terminal fragment (p30) comprises the CenA catalytic domain; this can be purified from the digest by size-exclusion chromatography (FIG. 3, lane 2). The corresponding amino-terminal fragment, which comprises the CBD plus the PT box, is produced in non-stoichiometric proportions, presumably because it is susceptible to further proteolysis Gilkes et al. (1988) supra. Therefore, an alternative method for the production of this polypeptide was adopted.

The cenA gene was manipulated in vitro to remove the region encoding the catalytic domain (FIG. 1A). The resulting gene fragment was ligated into pUC18 to give the recombinant plasmid pUC18-CBD.PT (FIG. 1B) which was used to transform *E. coli*. The cenA gene fragment on this plasmid encodes the protein CBD.PT$_{CenA}$ (i.e. the entire CBD, plus the P.T box lacking Thr 165), as shown in FIG. 1C. CBD.PT$_{CenA}$ was purified from an *E. coli* JM101 (pUC18-CBD.PT) cell extract by cellulose affinity chromatography Gilkes et al. (1988) supra and anion-exchange chromatography (FIG. 2). CBD.PT$_{CenA}$ bound very weakly to the anion-exchange column at pH 9.4 (i.e. 3.2 pH units above its theoretical pI), presumably because of its low charge density Warren et al. *Proteins* (1986) 1: 335–341. However, since contaminating proteins were more strongly bound, the chromatographic step was effective. The purified CBD.PT$_{CenA}$ preparation was homogeneous, as judged by SDS-PAGE (FIG. 3, lane 1). Its apparent molecular mass (20.0 kDa), relative to standard proteins, was greater than the molecular mass predicted from its primary structure (14.1 kDa). The PT box was previously shown to cause anomalous electrophoretic migration Gilkes et al. (1989) supra and Shen et al. *J. Biol Chem* (1991) 266: 11335–11340. p30 was also purified to apparent homogeneity (FIG. 3, lane 2); a minor (≦1% total) 30 kDa contaminant was evident in the purified CenA preparation (FIG. 3, lane 3).

Example 2

Binding of CenA, CBD.PT and p30

Analysis of the adsorption of CenA, CBD.PT$_{CenA}$ A and p3 to BMCC.

The kinetics of t he adsorption of CenA and CBD.PT$_{CenA}$ to BMCC at 30° are described below. High and low total protein concentrations, relative to the concentration range used to measure adsorption isotherms, were tested. Equilibration was complete within the shortest experimentally feasible incubation time (0.2 min), at both concentrations. There was no net desorption of either protein during the following 16.7h. There was no detectable adsorption of p30. Hydrolysis of BMCC after 18 h incubation with 18.3 $\mu$M CenA amounted to 2.7% of the total cellulose, as determined by the release of soluble reducing sugar; 0.8% hydrolysis was obtained with 18.3 $\mu$M p30. The absence of p30 adsorption found in the kinetic experiment was confirmed. Saturation of BMCC by CenA and CBD.PT$_{CenA}$ was approached but not attained at the highest total protein concentrations used. This failure to reach saturation was emphasized when the same data was plotted in semi-logarithmic form (b vs. log F). Scatchard plots of the data for CenA and CBD.PT$_{CenA}$ were non-linear (concave upward), indicating a complex interaction of these proteins with BMCC. A dissociation constant ($K_d$, describing the intrinsic affinity of the protein for BMCC) of 0.0768±0.0164 $\mu$M was determined for the adsorption of CenA from the limiting slope of the double reciprocal (1/B vs 1/F) data plot, as discussed below. The $K_d$ determined for CBD.PT$_{CenA}$ by the same method was 0.0617±0.0067 $\mu$M.

Example 3

Surface Modification dewaxed cotton by CBD.PT and p30; CBD.PT opens fibers and p30 polishes fibers Various concentrations of CenA, CBD.PT or p30 in phosphate buffer containing azide were shaken (37° C., 300 rpm, New Brunswick Model G25 shaker incubator) with 25 mg of dewaxed cotton (Hudson and Hay, *Practiced Immulology* (1976) (Blackwell Scientific Publications)) in siliconized glass vials to release small particles (Wood, *Methods in Enxymology* (1988) 160:19–21). Controls contained cotton and buffer alone or protein and buffer alone. The glass vials were removed at suitable intervals and the contents agitated for one minute with a vortex mixer. One ml of the 'supernatant' was removed immediately and absorption measurements were taken at 600 nm against a phosphate buffer blank. This sample was then returned to the vial and incubation was continued until the next reading. At the end of the 72 hour incubation, the "supernatants" were removed from each of the vials and centrifuged (20,000 g, 30 min) to remove particulate matter. The resulting clarified supernatants were assayed for soluble carbohydrate using orcinol-sulfuric acid (White and Kennedy, *Carbohydrate Analysis: a Practical Approach* (1986) (Chaplin and Kennedy, Eds) p. 38 IRL Press, Oxford. The pellets were washed several times with distilled water and finally resuspended in 0.5 ml of sterile distilled water. Samples of the suspensions were examined by phase contrast microscopy and scanning electron microscopy.

Example 4

Figure 4:
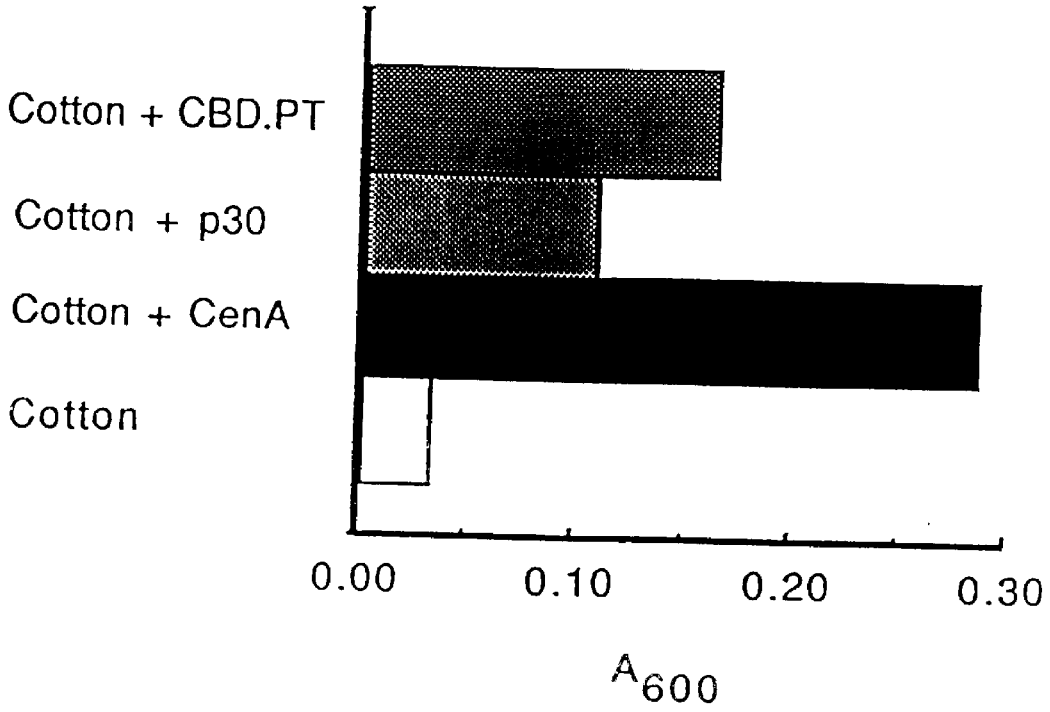
FIG. 4 shows small particle production from dewaxed cotton by the proteins CBD.PT, CenA or p30 after 2 min of incubation. Protein concentrations and conditions used are the same as described for FIG. 3. CenA, p30 and CBD.PT controls without cotton gave negligible $A_{600}$ readings.
Figure 5:
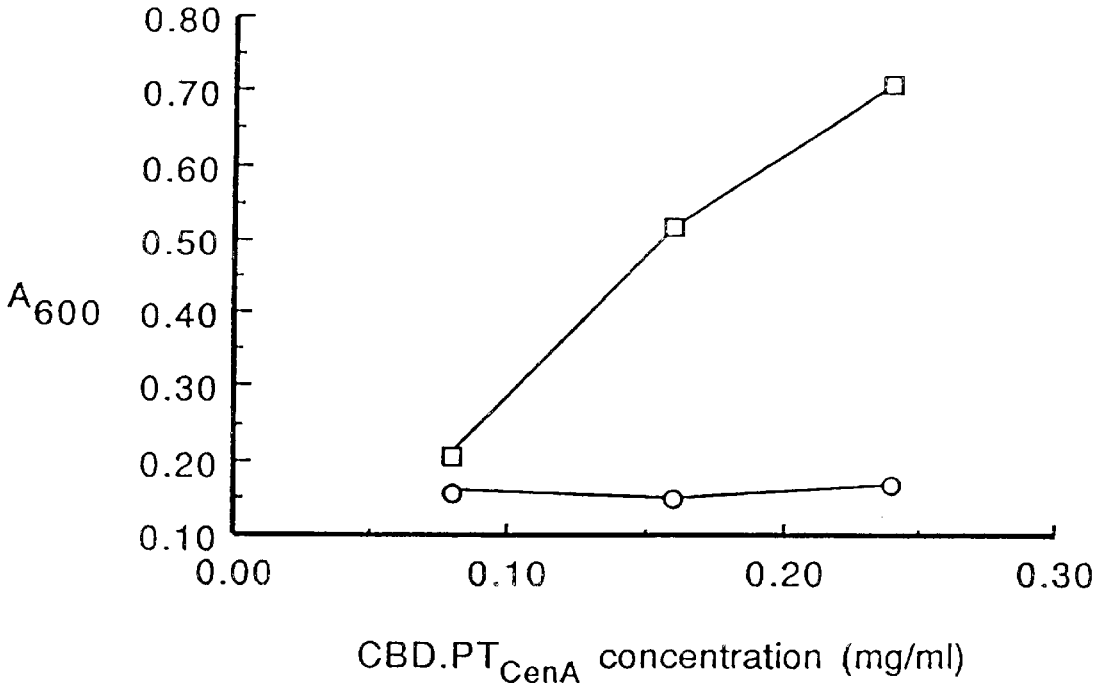
FIG. 5 shows small particle production from dewaxed cotton by CBD.PT. Various concentrations of CBD.PT were incubated with, □, or without, O, cotton for 72 h.

Modification of Ramie fibers by CBD.PT and p30; CBD.PT opens the internal structure Treatment of dewaxed cotton fibers with CenA, p30 or CBD.PT led to the release of small bundles of microfibrils called small particles. These particles were visible to the naked eye as a haziness in the supernatant after treatment and settling of the bulk of the cotton mass. The particles were quantified by measuring the turbidity of the supernatant at 600 nm. CenA and p30 released particles throughout the period of incubation, presumably by hydrolyzing cellulose molecules within the fibers (FIG. 3). In contrast, CBD.PT released fewer small particles than CenA or p30 and the release was discontinuous. Most of the particles appeared within two minutes (FIG. 4). Furthermore, the release of small particles by CBD.PT was concentration-dependent (FIG. 5).

After 72 h incubation, soluble carbohydrate could not be detected in the clarified supernatants from the CBD.PT and the buffer control incubations (<0.01 mg ml$^{-1}$) whereas CenA and p30 proteins released equivalent amounts (0.110 mg ml$^{-1}$ and 0.105 mg ml$^{-1}$ respectively).

The particles released by CenA were mostly small and irregular; there were also some larger particles (up to 0.5 mm in length) with very rough surfaces. In contrast the particles released by p30 were mostly short fibers 2 mm or less in length, with very smooth surfaces. The material released by CBD.PT was very similar to that released by CenA, i.e. predominantly smaller particles. The surface of the fibers in the residual cotton mass following incubation with CenA or CBD were rough and disrupted. As previously seen for ramie fibers, cotton fibers were polished by p30.

Particles released by CenA and CBD.PT were boiled for 5 minutes with SDS-urea buffer (0.0625M Tris,pH 6.8, 10% glycerol, 2% SDS, 0.05% β-mercaptoethanol and 1M urea) to ensure that the 'small particles' were in fact cotton fragments and not protein aggregates. There were no changes in the appearance of the small particles after the boiling step.

Ramie cotton fibers were cut in half and soaked overnight in phosphate buffer containing 0.01% $NaN_3$. Individual halves were then incubated with one of the test proteins CenA, p30 CBD.PT or CBD, 10 $\mu$M in phosphate buffer plus azide or incubated with buffer alone as controls. After incubation for 72 h at 37° C. without agitation, the fibers were washed with distilled water and treated with proteinase K (50 $\mu$g $ml^{-1}$, 37° C.,20 min) to remove bound protein. The fibers were washed again with sterile distilled water, dried, and secured onto S.E.M. aluminum stubs, using Avery sticky tabs. They were then coated with gold using a sputter coater and examined with a Cambridge steroscan microscope 250. Distinct surface changes were evident after treatment (FIG. 1).

Intact CenA caused extensive disruptions along the length of the fiber. Similar areas of disruption were observed on the fibers incubated with CBD.PT, but these were not as extensive nor as uniform as seen with CenA. The surface layers were exfoliated to reveal the underlying layers of microfibrils at "hot spots" along the fiber.

The surfaces of untreated fibers were relatively smooth with a few natural irregularities. In contrast, fibers treated with p30, were devoid of irregularities, appearing highly 'polished' along their entire lengths. This smoothing effect of the catalytic domain (p30) was in marked contrast to the disruptive effects of the intact enzyme or its binding domain.

Ramie cellulose fibers were pretreated with the proteins CenA, p30, CBD.PT or CBD exactly as described for S.E.M. analysis. Following proteinase K treatment and washing, the fibers were incubated with fluorescein-labeled CBD, 10 $\mu$g $ml^{-1}$ in phosphate buffer, for 15 min at 20° C. and washed with distilled water. CBD was labeled with fluorescein isothiocyanate as described by Hudson and Hay (15). The fluorescein to protein ratio, determined by optical density, was 1.2.

Fibers were examined as wet mounts with a confocal scanning microscope (Bio-Rad, MRC 500) using the argon laser to excite the fluorescein. Images were reconstructed using Data View Software (Computing Services, University of British Columbia, Vancouver) or Voxal View Software (Vital Images, Inc., Fairfield, Iowa). The untreated fiber showed very sparse binding of the label confined to patches on its surface. Treatment of a fiber with CenA markedly increased the access of the labelled probe to the interior of the fiber indicating that the intact endoglucanase disrupted its structural integrity. CBD and CBD.PT also disrupted the fiber structure but to a lesser extent than CenA (FIG. 2). Penetration of the label was most evident at hot spots where the surface of the fiber was exfoliated. The concentration of fluorescenated CBD used was less than one tenth the minimum concentration used for treatment of the fibers (eg. see following section).

In contrast to pretreatment with CenA or the CBD preparations, fibers pretreated with p30 showed little binding of the fluorescenated CBD and only to their surfaces.

Crude cellulase mixtures with high-binding affinity are more effective in the hydrolysis of cotton than low affinity mixtures. The catalytic domain p30 has a drastically decreased affinity for Avicel, but its capacity to hydrolyse a soluble substrate such as CMC is retained. The action of the catalytic domain, p30, on cellulose is quite different from that of the binding domain or the intact enzyme. The cellulose is polished by p30 so that original surface disruptions in the cellulose are no longer visible. This is in sharp contrast to the disruptive effects of binding domain and CenA. It is a theory of the invention that p30 hydrolyzes glycosidic bonds on the surface of the cellulose where the surface is disrupted or broken away from the crystalline structure, resulting in the observed smoothing. The fragments released from cotton by p30 are quite different from those released by CBD and CenA, being mostly short fibers rather than small particles. Presumably, these arise by hydrolysis at regions of mechanical damage which extend across the entire fiber width.

The extensive penetration of the FITC-CBD probe following CenA pretreatment presumably reflects hydrolysis of disordered regions within the Ramie fiber; however, internal hydrolysis appears to be dependent on concomitant disruption by the binding domain since penetration is not enhanced by p30 treatment alone. The effect of CenA is the net result of the activities of binding domain and p30. The resultant rough surface of Ramie or cotton fibers suggests that for the intact enzyme, the polishing activity of p30 lags behind the disruptive effects of the CBD. A rational design of a cellulose hydrolysis scheme could involve balancing these activities to maximize the rate of solubilization. The availability of the individual components of such a system as recombinant DNA products renders this approach feasible. Furthermore, the ability to apply separately either the hydrolytic activity or the disruptive properties of such enzymes should be of significant value in the treatment of a variety of cellulosic materials in either the manufacturing or resource industries.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A method for modifying a polysaccharide fiber, said method comprising:

contacting said polysaccharide fiber with a sufficient amount of an isolated binding domain, obtained from a polysaccharidase, under conditions and for an amount of time sufficient to increase surface irregularities on said polysaccharide fiber, as compared to an untreated polysaccharide fiber.

2. The method according to claim 1, wherein said polysaccharide is cellulose.

3. The method according to claim 1, wherein said contacting step results in a polysaccharide fiber having a roughened surface.

4. A modified polysaccharide fiber obtained according to the method of claim 1.

5. A method for modifying a cellulose fiber, said method comprising:

contacting said cellulose fiber sequentially with a sufficient amount of an isolated binding domain and an isolated catalytic domain, wherein said domains are obtained from a cellulase, under conditions and for an amount of time to modify said cellulose fiber.

6. The method according to claim 5, wherein said cellulase is an endoglucanase or an exoglucanase.

7. The method according to claim 5, wherein said cellulase is obtained from *Cellulomonas fimi.*

8. The method according to claim 7, wherein said cellulase is cenA or cex.

9. The method according to claim 5, wherein said cellulose fiber is cotton.

10. Modified cellulose fibers obtained according to the method comprising:

contacting cellulose fibers pretreated to remove wax or gum with a sufficient amount of an isolated catalytic domain, obtained from an endoglucanase or an exoglucanase, under conditions and for a time sufficient to modify surface irregularities of said cellulose fibers, wherein the modification is apparent only on the surface of the fiber.

11. The modified cellulose fibers according to claim 10, wherein said cellulose fibers are cotton fibers and as a result of said contacting step fibers are obtained that are smoother than untreated cellulose fibers.

12. A method for modifying a cotton or a Ramie fiber, said method comprising:

contacting said cotton or said Ramie fiber with a sufficient amount of at least one isolated functional domain obtained from a polysaccharidase under conditions and for an amount of time such that the surface irregularities of said cotton or said Ramie fiber are modified, wherein said isolated functional domain is selected from the group consisting of a catalytic domain and a binding domain.

13. The method according to claim 12, wherein said modifying of cellulose fiber is decreasing of surface irregularities as compared to an untreated cellulose fiber.

14. The method according to claim 13, wherein said decreasing is removing of surface irregularities.

15. The method according to claim 12, wherein said modifying of cellulose fiber is increasing of surface irregularities, as compared to an untreated cellulose fiber.

16. The method according to claim 12, wherein, as a result of said modifying, as compared to an untreated fiber, said polysaccharide fiber has at least one property selected from the group consisting of:

(a) increased dye binding;

(b) increased dye penetration;

(c) roughened surfaces;

(d) smoothed surfaces;

(e) decreased number of loose ends;

(f) increased tied up loose ends;

(g) decreased tied up loose ends; and (h) increased porosity.

17. The method according to claim 12, wherein said polysaccharidase is a cellulase.

18. The method according to claim 17, wherein said cellulase is obtainable from *Cellulomonas fimi.*

19. Modified cellulose fibers obtained according to the method comprising:

contacting cellulose fibers pretreated to remove wax or gum with a sufficient amount of an isolated binding domain, obtained from an endoglucanase or an exoglucanase, under conditions and for a time sufficient to modify surface irregularities of said cellulose fibers.

20. The modified cellulose fibers according to claim 19, wherein said cellulose fibers are cotton fibers and as a result of said contacting step fibers are obtained that as compared to untreated fibers have a property selected from the group consisting of increased dye binding, increased dye penetration, roughened surface, decreased tied up loose ends and increased porosity.

* * * * *

UNITED STATES PATENT AND TRADEMARK OFFICE

CERTIFICATE OF CORRECTION

PATENT NO. : 5,821,358
DATED : October 13, 1998
INVENTOR(S) : Neil R. Gilkes, Douglas G. Kilburn, Robert C. Miller, Jr., and Anthony Warren It is certified that error appears in the above-identified patent and that said Letters Patent is hereby corrected as shown below:

In column 1, line 7, "23" should read --29--.

In column 9, line 53, "CBD.PT$_{CenA}$A" should read --CBD.PT$_{CenA}$--;

line 54, "p3" should read --p30--.

In column 10, line 1, "CBD.PT$_{CenA}$" should read --CBD.PT$_{CenA}$--;

line 6, "CBD.PT$_{CenA}$" should read --CBD.PT$_{CenA}$--;

line 12, "CBD.PT$_{CenA}$" should read --CBD.PT$_{CenA}$--;

line 22, "*lology*" should read --*nology*--;

line 24, "*Enxymology*' should read --*Enzymology*--.

In column 11, line 23, "stubs" should read --tabs--.

Signed and Sealed this

Fourteenth Day of November, 2000

*Attest:*

*Attesting Officer*

Q. TODD DICKINSON

*Director of Patents and Trademarks*